United States Patent [19]

Dreher et al.

[11] 4,324,510

[45] Apr. 13, 1982

[54] APPARATUS FOR SUPPORTING A MINE ROOF SUPPORT ASSEMBLY

[75] Inventors: Hans-Joachim Dreher, Dortmund-Asseln; Kunibert Becker, Werl, both of Fed. Rep. of Germany

[73] Assignee: Gewerkschaft Eisenhutte Westfalia, Fed. Rep. of Germany

[21] Appl. No.: 143,721

[22] Filed: Apr. 25, 1980

[30] Foreign Application Priority Data

Apr. 24, 1979 [DE] Fed. Rep. of Germany ..... 2917047

[51] Int. Cl.[3] ..... E21D 15/44

[52] U.S. Cl. ..... 405/291; 405/192

[58] Field of Search ..... 405/291-301; 299/31

[56] References Cited

U.S. PATENT DOCUMENTS 4,183,700 1/1980 Klinggraff et al. ..... 405/291

FOREIGN PATENT DOCUMENTS 2549941 5/1977 Fed. Rep. of Germany ..... 405/291
2745429 4/1979 Fed. Rep. of Germany ..... 405/291
412385 9/1974 U.S.S.R. ..... 405/291
659759 4/1979 U.S.S.R. ..... 405/291

*Primary Examiner*—Dennis L. Taylor
*Attorney, Agent, or Firm*—Thompson, Birch, Gauthier & Samuels

[57] ABSTRACT

Apparatus is disclosed for supporting the lowermost roof support unit of a series of roof support units positioned side-by-side in an inclined longwall working. The support apparatus comprises a beam mounted for pivotal movement in a plane parallel to the floor of the working. The beam can be held in any given angular position. A support plate is provided for engagement with the side of the lowermost roof support unit. The support plate is movable towards, and away from, the beam by means of hydraulic rams, which also constitute means for holding the support plate and the beam at any given spacing within a predetermined range of spacings.

12 Claims, 1 Drawing Figure

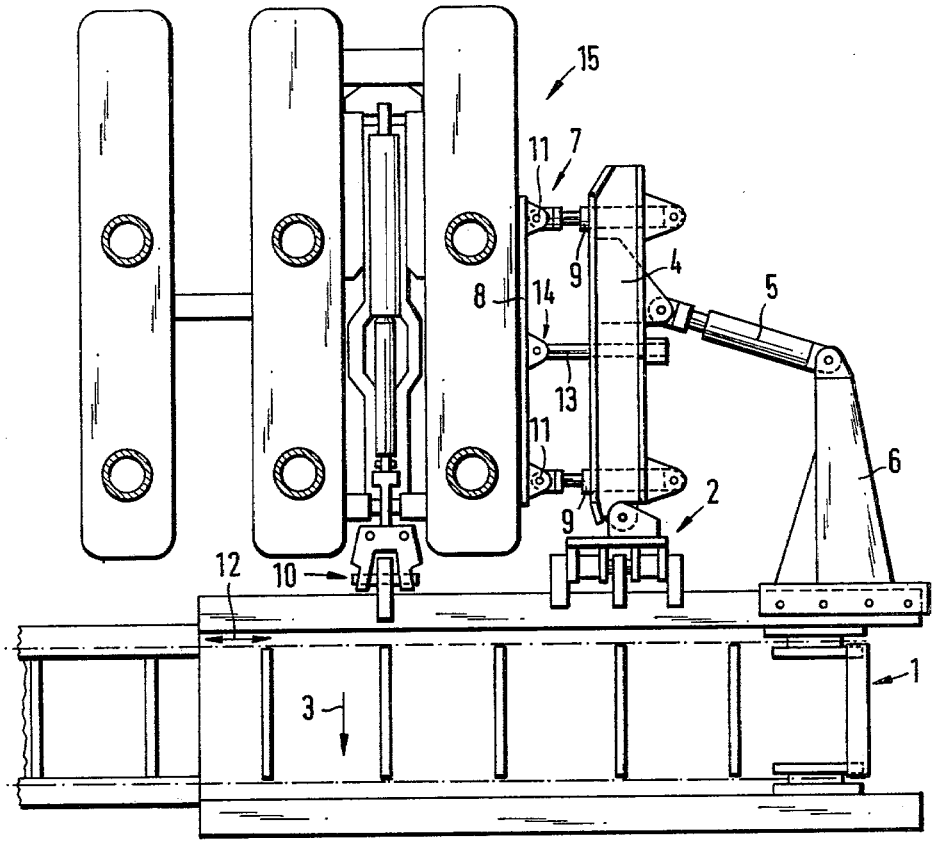
15
11
7
9
4
5
8
14
13
11
6
2
9
12
10
1
3

APPARATUS FOR SUPPORTING A MINE ROOF SUPPORT ASSEMBLY

BACKGROUND OF THE INVENTION

This invention relates to apparatus for supporting the lower end of a mine roof support assembly which is used in inclined workings.

A known type of mine roof support assembly is constituted by a plurality of roof support units positioned side-by-side along, for example, a longwall face. Each of the units has a roof shield supported on a floor sill by means of hydraulic props. In mining operations involving steeply inclined seams, the floor of the working is also steeply inclined, in which case means must be provided for preventing the roof support units slipping in the direction of dip.

One known method of preventing such slip is to provide the lowest roof support unit with support apparatus which fixes that unit rigidly to the goaf side of the face-side conveyor at a fixed angle thereto. Thus, the support apparatus provides lateral support for this lowest roof support unit. Under normal conditions, it is possible for this system to counteract the tendency of the entire roof support assembly to slip down the inclined floor of the working.

A known type of support apparatus has a rigid beam for laterally supporting the lowermost roof support unit. The rigid beam is attached to the conveyor which extends along the working. The beam is angularly adjustable in a plane parallel to the floor of the working, and can be locked in any desired angular position. Although this form of apparatus provides adequate support, it does not permit accurate alignment of the roof support units without employing additional means such as an anchoring device. This disadvantage results from it being impossible for this type of apparatus to adjust the position of the lowermost roof support unit only in the direction of face advance (that is to say without adjusting the position of that unit in the direction of the longwall working). The need to use additional means such as an anchoring device requires considerable expenditure of power. Moreover, such devices are difficult to control, particularly as they are situated in the congested end regions of longwall installations.

The aim of the invention is to provide support apparatus which does not suffer from these disadvantages.

SUMMARY OF THE INVENTION

The present invention provides an apparatus for supporting the lowermost roof support unit of a series of roof support units positioned side-by-side in an inclined longwall working, the apparatus comprising a beam mounted for pivotal movement in a plane parallel to the floor of the working, means for holding the beam in any given position, and a support device for engagement with the side of the lowermost roof support unit, wherein the support device is movable towards and away from, the beam, and wherein means are provided for holding the support device and the beam at any given spacing within a predetermined range of spacings.

The lowermost roof support unit is, thus, supported on the beam via the adjustable support device. Consequently, by adjusting the position of the support device, any longitudinal movement (that is to say movement in the longwall direction) of the support position can be offset, so that the lowermost roof support unit can be aligned without it moving in the longwall direction.

Advantageously, the beam is pivotally mounted on a pedestal fixed to a conveyor which extends along the longwall working. Preferably, a hydraulic ram constitutes the means for pivoting the beam and for holding the beam in any given position, the hydraulic ram being pivotally attached to both the beam and the conveyor.

Conveniently, the support device is constituted by a plate which is attached to the beam by means of a pair of hydraulic rams positioned adjacent to the ends of the plate, the plate extending generally in the direction in which the conveyor is advanced. This form of support device is simple, reliable and economical to produce.

Preferably, the plate is guided for movement towards, and away from, the beam by means of a guide rod, the guide rod being pivotally attached to the plate, and slidably engaging within an aperture in the beam. This enables the effective displacement range of the beam to be increased considerably.

BRIEF DESCRIPTION OF THE DRAWINGS

The invention will now be described in greater detail, by way of example, with reference to the accompanying drawing, the single FIGURE of which is a plan view of support apparatus constructed in accordance with the invention.

DESCRIPTION OF PREFERRED EMBODIMENT

Referring to the drawing, the support apparatus is shown positioned at the lower end of a conveyor 1 which extends along an inclined longwall working (not shown). A pedestal 2 is fixed to the goaf side of the conveyor 1, at a point adjacent to the lower end thereof. A beam 4 is pivotally mounted on the pedestal 2, for pivotal movement in a plane parallel to that of the floor of the working. The beam 4 extends substantially in the direction 3 of conveyor advance. A hydraulic ram 5 is provided for pivoting the beam 4, the ram being pivotally mounted between the "downhill" side of the beam and a pedestal 6 which is bolted on to the goaf side of the conveyor 1 at the lower end thereof.

The "uphill" side of the beam 4 carries a support device 7 for engaging the lowermost roof support unit 15 of a roof support assembly positioned on the goaf side of the conveyor 1. The support device 7 has a plate 8 held on the beam 4 by means of hydraulic rams 9 at its two ends. Each ram 9 is pivotally attached to the plate 8, by means of a pivot pin 11 whose axis is perpendicular to the floor of the working. Similarly, the rams 9 are pivotally attached to brackets mounted on the beam 4. The plate 8 is adjustable, in the direction 12 of the longwall working, by means of the rams 9, the plate being guided during adjustments by means of a guide rod 13 which is slidably received within an aperture in the beam 4. The guide rod 13 is pivotally attached to the plate 8 by means of a pivot pin 14 whose axis is perpendicular to the floor of the working. The guide rod 13 is prevented (in a manner not shown) from twisting.

In the illustrated position, the lowermost roof support unit 15 (which is not shown in detail) is indirectly supported on the beam 4 by way of the plate 8. The roof support unit 15 is connected to the conveyor 1 by guide means 10 of a known type. When the roof support unit 15 needs to be re-aligned in the direction 3 of conveyor advance, the hydraulic ram 5 is either extended (or retracted) to effect the correct alignment. Any resultant movement of the beam 4 in the direction 12 of the longwall working, is offset by a simultaneous retraction (or extension) of the rams 9. Thus, the roof support unit 15 can be accurately aligned in the direction 3 of the conveyor advance, without that roof support unit being moved bodily in the direction 12 of the longwall working. Moreover, by extending or retracting the hydraulic rams 9 to different extents, not only is the effective displacement range increased, but the roof support unit 15 can then also be supported and aligned as required, even if previously it was not parallel to the beam 4.

The remaining roof support units (not shown) of the assembly are aligned one-by-one starting with the unit adjacent to the unit 15, each unit relying on the adjacent downhill unit for support during alignment.

We claim:

1. Apparatus for supporting the lowermost roof support unit of a series of roof support units positioned side-by-side on the goaf side of a conveyor in an inclined longwall working, the apparatus comprising a beam mounted on the conveyor for pivotal movement in a plane parallel to the floor of the working, means for pivoting and holding the beam in any given position relative to the conveyor, a support device for engagement with the lower side of the lowermost roof support unit, said support device being connected to and being movable towards, and away from, the beam, and means for holding the support device and the beam at any given spacing within a predetermined range of spacings.

2. Apparatus according to claim 1, wherein the beam is pivotally mounted on a pedestal fixed to said conveyor.

3. Apparatus according to claim 2, wherein a hydraulic ram constitutes the means for pivoting the beam and for holding the beam in any given position, the hydraulic ram being pivotally attached to both the beam and the conveyor.

4. Apparatus according to claim 2, wherein the support device is constituted by a plate which is attached to the beam by means of a pair of hydraulic rams positioned adjacent to the ends of the plate.

5. Apparatus according to claim 4, wherein the plate extends generally in the direction in which the conveyor is advanced.

6. Apparatus according to claim 4, wherein the plate is guided for movement towards, and away from, the beam by means of a guide rod, the guide rod being pivotally attached to the plate and slidably engaged within an aperture in the beam.

7. A mineral mining installation comprising a conveyor, a series of roof support units positioned side-by-side in an inclined longwall working on the goaf side of the conveyor, and support apparatus for supporting the lowermost roof support unit, the support apparatus comprising a beam supported on the conveyor for pivotal movement in a plane parallel to the floor of the working, means for holding the beam in any given position, said beam holding means being positioned between the beam and the conveyor, and a support device contacting the lower side of the lowermost roof support unit, the support device being positioned between the beam and said lower side of the lowermost roof support unit, wherein the support device is provided with means for moving the support device towards, and away from, the beam, and wherein the beam is provided with means for holding the support device and the beam at any given spacing within a predetermined range of spacings.

8. An installation according to claim 7, wherein the beam is pivotally mounted on a pedestal fixed to the conveyor.

9. An installation according to claim 7, wherein a hydraulic ram is provided for pivoting the beam, said hydraulic ram also comprising said beam holding means, and said hydraulic ram being pivotally attached to both the beam and the conveyor.

10. An installation according to claim 7 wherein the support device comprises a plate which is attached to the beam by means of a pair of hydraulic rams positioned adjacent to the ends of the plate.

11. An installation according to claim 10, wherein the plate extends generally in the direction in which the conveyor is advanced.

12. An installation according to claim 10, wherein the plate is guided for movement towards, and away from, the beam by means of a guide rod, the guide rod being pivotally attached to the plate and slidably engaging within an aperture in the beam.

* * * * *